US007503783B2

(12) United States Patent
Ting

(10) Patent No.: US 7,503,783 B2
(45) Date of Patent: Mar. 17, 2009

(54) ELECTRICAL CARD CONNECTOR

(75) Inventor: Chien-Jen Ting, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/005,947

(22) Filed: Dec. 27, 2007

(65) Prior Publication Data

US 2008/0160807 A1 Jul. 3, 2008

(30) Foreign Application Priority Data

Dec. 27, 2006 (TW) ..... 95222920 U

(51) Int. Cl.
*H01R 13/62* (2006.01)

(52) U.S. Cl. ..... 439/159; 439/607; 439/631

(58) Field of Classification Search ..... 439/607, 439/159, 629, 630, 631
See application file for complete search history.

(56) References Cited

U.S. PATENT DOCUMENTS 7,118,396 B2 10/2006 Ting
7,195,501 B2 3/2007 Zhao
2005/0009389 A1* 1/2005 Chang ..... 439/159
2006/0089032 A1* 4/2006 Chen ..... 439/159
2006/0089033 A1* 4/2006 Chen ..... 439/159
2006/0270260 A1* 11/2006 Chen et al. ..... 439/159
2007/0032108 A1* 2/2007 Hsu ..... 439/159

* cited by examiner

*Primary Examiner*—Hien Vu
(74) *Attorney, Agent, or Firm*—Wei Te Chung

(57) ABSTRACT

An electrical card connector (100) includes an insulating housing (2), a plurality of terminals (31) received in the insulating housing, a metal shield (1) shielding over the insulating housing and an ejector (4). The metal shield and the insulating housing define a card receiving room and a card inserting direction. The ejector includes a drawer plate (40), a slider pin (41) and a resilient portion (42). The drawer plate defines a retaining hole (4000) and a limiting hole (4001) at a backside of the retaining hole. The slider pin forms a bending corner (411, 412) at each end thereof, and one of the bending corners extends through the retaining hole and the other bending corner is confined to the limiting hole.

9 Claims, 8 Drawing Sheets

ELECTRICAL CARD CONNECTOR

BACKGROUND OF THE INVENTION

1. Field of the Invention

The present invention relates generally to an electrical card connector, and particularly to an electrical card connector with an ejector.

2. Description of Related Arts

With a development of electronic appliances, an electrical card connector has been widely used to achieve data transmission between an electrical card and a corresponding electronic appliance. In order to draw the electrical card out of the card connector conveniently, the electrical card connector usually has an ejector to eject the electrical card. A conventional ejector usually has a resilient element, a pin member and a slider, shown as U.S. Pat. No. 7,195,501. For the slider is a very massive plastic member, it takes a relatively large space of the electrical card connector, thus it is not suitable to the miniaturization of electronic appliance. Another one prior art has been shown as U.S. Pat. No. 7,118,396, that is an electrical card connector having an ejector composed of a base, a guiding pin, a spring, a pushing bar and an ejecting plate. The guiding pin is placed in a horizontal plane, with two ends extending into two different directions, thus, one end locks with the spring, and then goes through an aperture of the pushing bar to combine the spring, the guiding pin and the pushing bar in a whole, and the other one end slides in a heart groove formed on the base. For the two ends of the guiding pin extend in two different directions, the ejector takes some needless space of the electrical card connector. Especially, a kind of electrical card connector called smart card connector has a smaller size, so, conventional ejectors said above don't meet the requirement.

Hence, an electrical card connector with an improved ejector is desired.

SUMMARY OF THE INVENTION

Accordingly, an object of the present invention is to provide an electrical card connector, which is effectively reduced in size.

To achieve the above object, an electrical card connector includes an insulating housing, a plurality of terminals received in the insulating housing, a metal shield shielding over the insulating housing and an ejector. The metal shield and the insulating housing define a card receiving room and a card inserting direction. The ejector includes a drawer plate, a slider pin and a resilient portion. The drawer plate defines a retaining hole and a limiting hole at a backside of the retaining hole. The slider pin forms a bending corner at each end thereof, and one of the bending corners extends through the retaining hole and the other bending corner is confined to the limiting hole.

Other objects, advantages and novel features of the invention will become more apparent from the following detailed description when taken in conjunction with the accompanying drawings.

DETAILED DESCRIPTION OF THE PREFERRED EMBODIMENT

Figure 1:
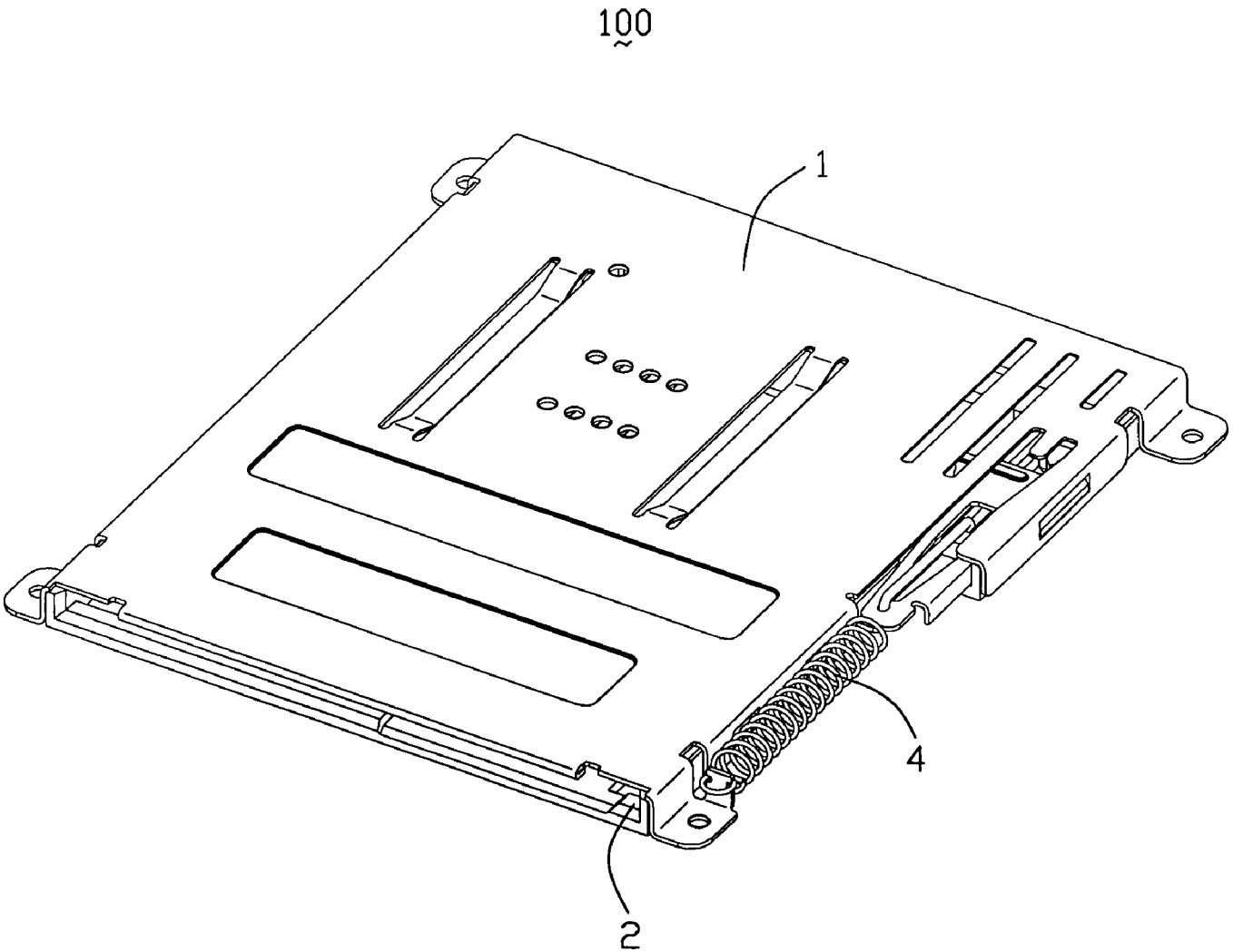
FIG. 1 is a perspective, assembled view of an electrical card connector without an electrical card inserted therein in accordance with the present invention.
Figure 2:
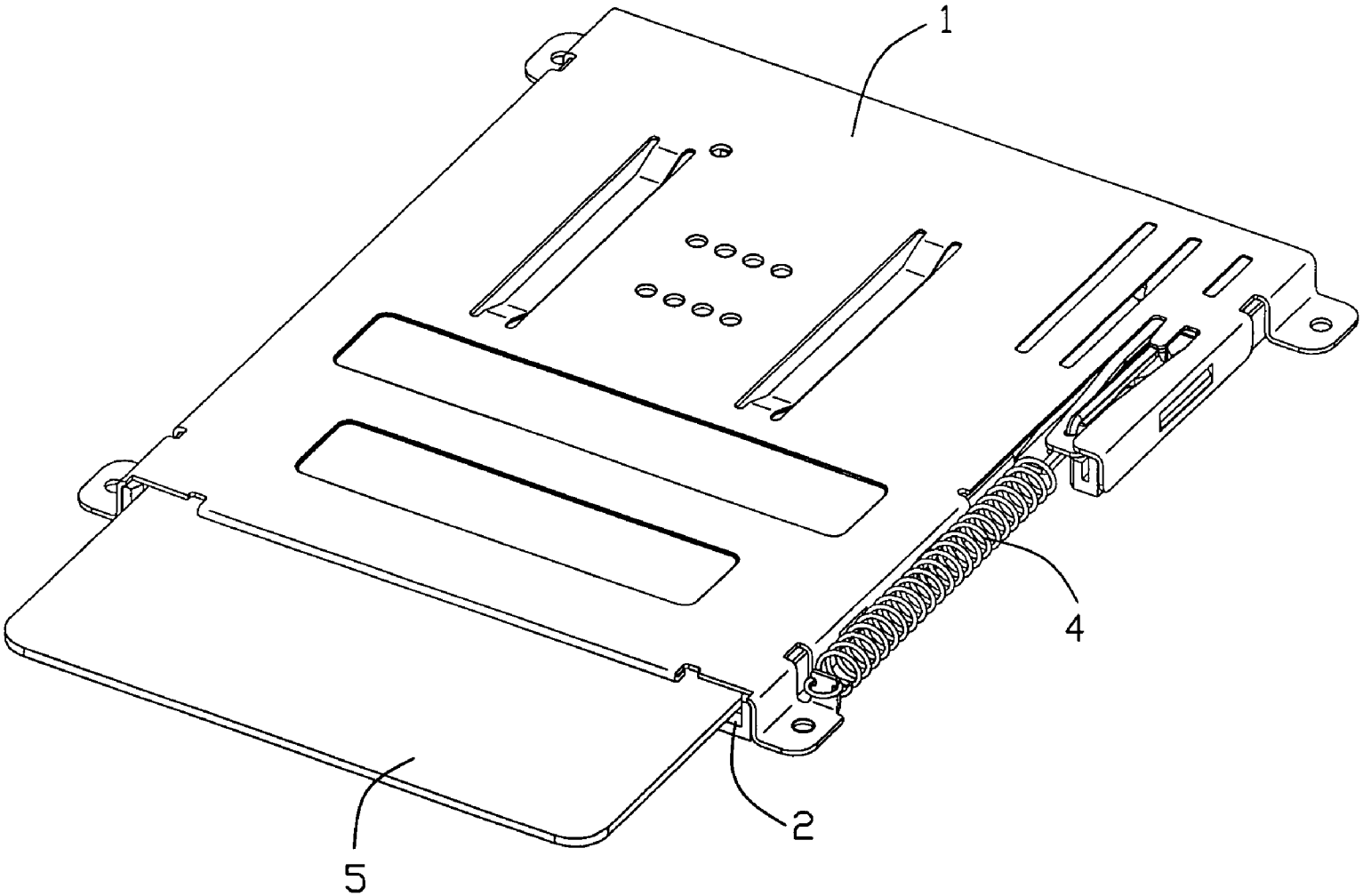
FIG. 2 is a perspective, assembled view of the electrical card connector with an electrical card inserted therein.
Figure 3:
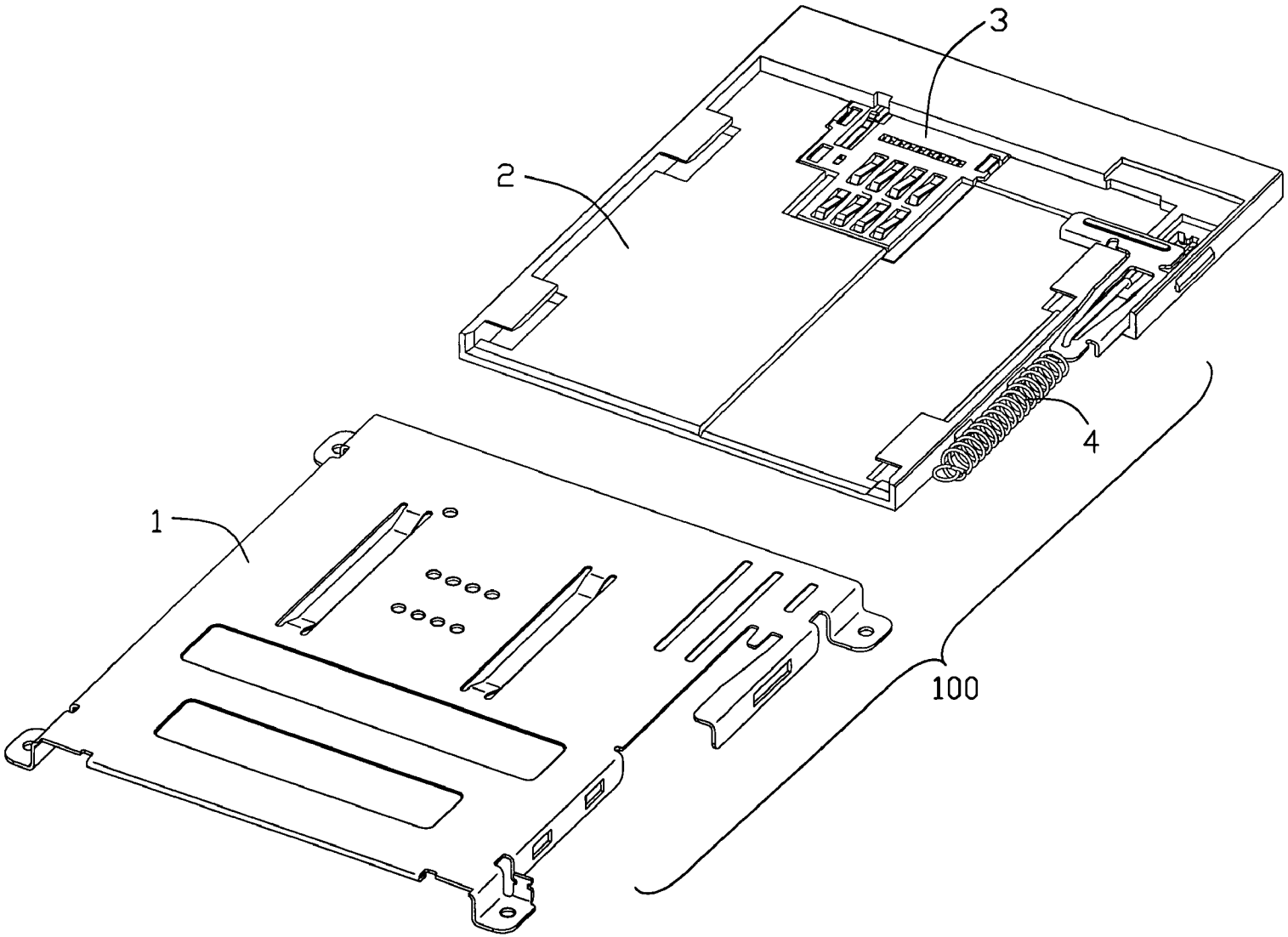
FIG. 3 is a perspective, partly exploded view of the electrical card connector when the electrical card is not inserted.
Figure 4:
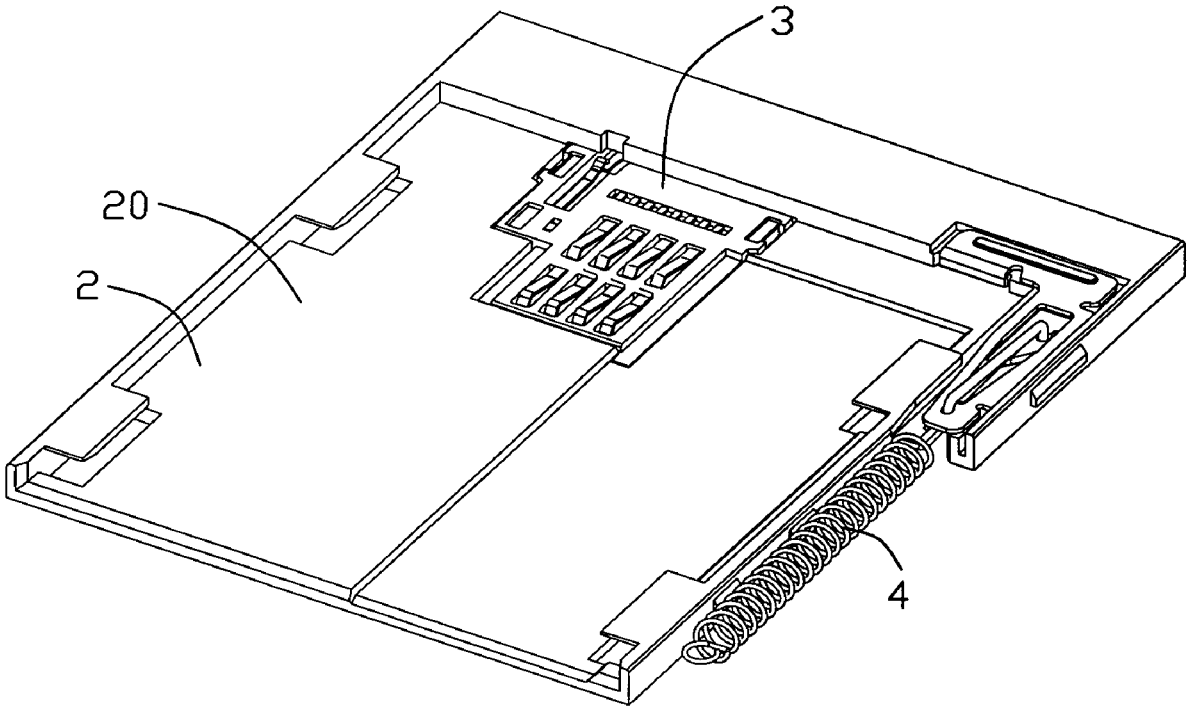
FIG. 4 is a partly assembled view of the electrical card connector when the electrical card is inserted.

Referring to FIGS. 1-8, an electrical card connector 100, assembled on a PCB (not shown), comprises a metal shield 1, an insulating housing 2, a terminal module 3 received in the insulating housing 2 and an ejector 4 assembled on the metal shield 1 and the insulating housing 2. The metal shield 1 and the insulating housing 2 together define a receiving room (not labeled) for receiving an electrical card 5 and defining a card inserting direction.

Figure 5:
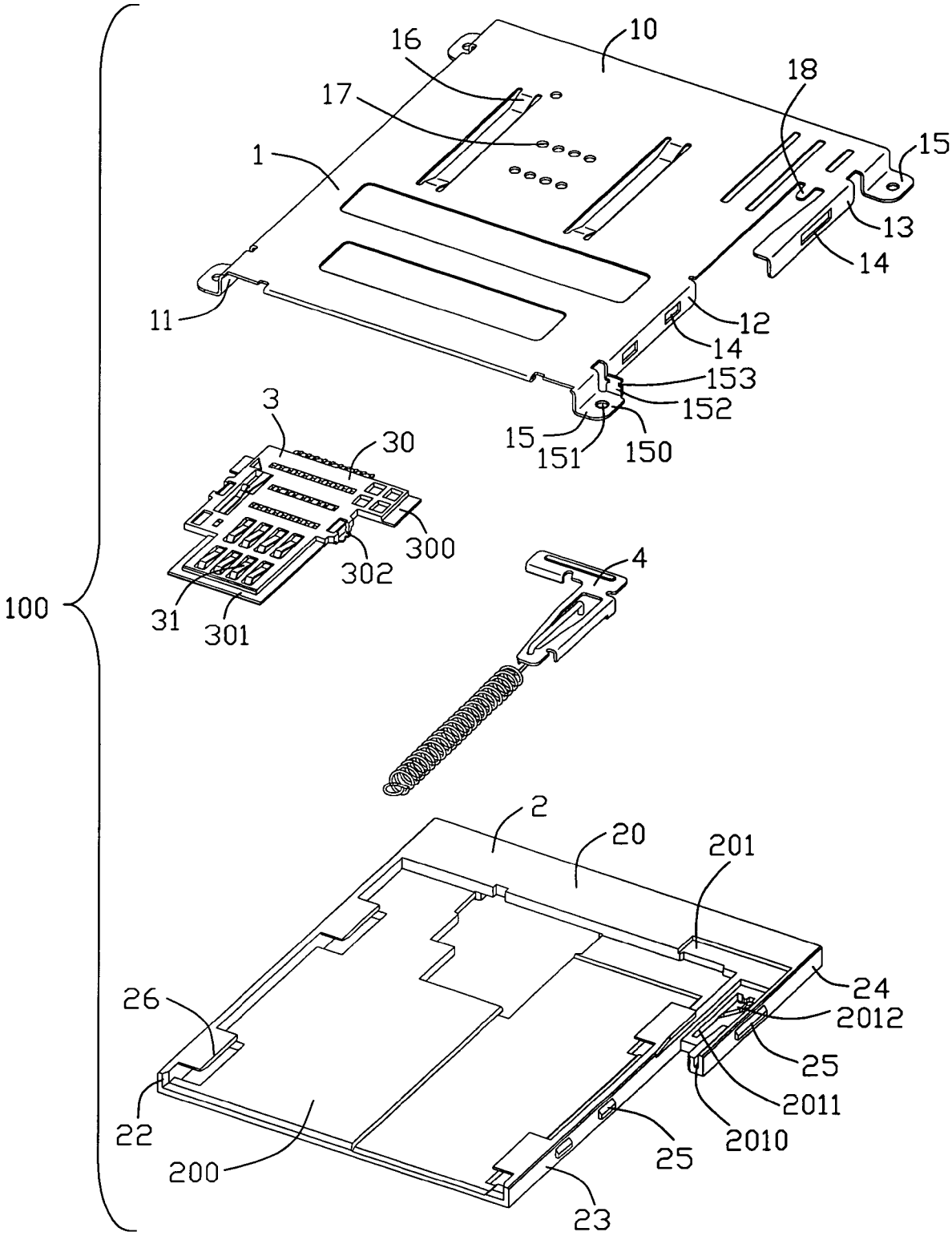
FIG. 5 is a perspective, fully exploded view of the electrical card connector.

Referring to FIG. 5, the metal shield 1 comprises a base 10, a first lateral wall 11, a second lateral wall 12 and a third lateral wall 13. A pair of depressing pieces 16, extending along the card inserting direction, are formed in the middle of the base 10. A plurality of holes 17 are defined on the base 10 and between the pair of depressing pieces 16. The first lateral wall 11 extends vertically and downwardly from an edge of the base 10. The second lateral wall 12 and the third lateral wall 13 both extend vertically and downwardly from an opposite edge of the base 10 relative to the first lateral wall 11, and further more, a distance between the second lateral wall 12 and the first lateral wall 11 is shorter than that between the third lateral wall 13 and the first lateral wall 11. Each lateral wall 11, 12, 13 defines at least a slot 14 and forms at least a locking board 15 thereon. Each locking board 15 comprises a tongue portion 150 with an orientation hole 151 defined thereon. Additionally, the locking board 15 of the second lateral wall 12 further comprises a fixing piece 152 extending vertically and upwardly from a rear end thereof. The fixing piece 152 defines a pair of recesses 153. Another one remarkable character is that an interspace (not labeled) is arranged between the base 10 and the third lateral wall 13, and an elastic piece 18, extending from the base 10 along a direction opposite to the card inserting direction, extends into the interspace. The terms "vertically, upwardly and rear" are not meant to be limiting but is descriptive of depiction according to the claims.

Figure 6:
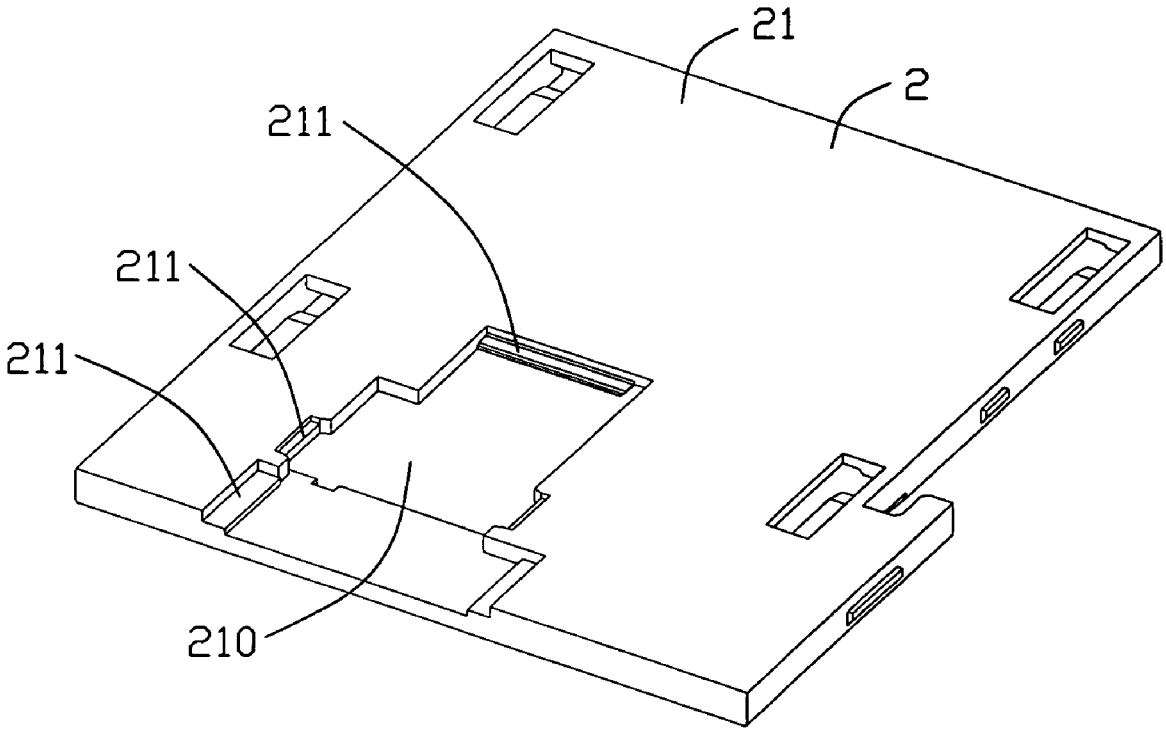
FIG. 6 is a view of an insulating housing of the electrical card connector.

Referring to FIGS. 5-6, the insulating housing 2 comprises a top surface 20, a bottom surface 21, a first lateral side 22, a second lateral side 23 and a third lateral side 24. Each lateral side 22, 23, 24 forms at least a protrusion 25 correspondingly received in the slot 14 of the metal shield 1. The top surface 20 comprises a depressed portion 200 for defining the card receiving room and an L-shaped depressed portion 201 for receiving the ejector 4. The depressed portion 200 forms a plurality of limiting boards 26 extending from upper surfaces of the first and second lateral walls 22, 23 for guiding and limiting the inserted electrical card 5. The L-shaped depressed portion 201 comprises a guiding channel 2010, a sliding channel 2011 located at a side of the guiding channel 2010 and a heart-shaped channel 2012 located between the guiding channel 2010 and the sliding channel 2011 and communicating with the sliding channel 2011. The bottom surface 21 comprises a receiving portion 210 having a plurality of stepped portions 211.

The terminal module 3 comprises a body portion 30 and a plurality of signal terminals 31 each having a contacting portion (not labeled) and a soldering portion (not labeled). The body portion 30 forms a pair of first extending portions 300 at a rear part, a second extending portion 301 at a front end and a pair of metal ears 302 assembled at opposite sides of a middle part, respectively and correspondingly mating with the stepped portions 211 of the receiving portion 210. Because the shape of the terminal module 3 is approximately the same with the receiving portion 210 of the insulating housing 2, the terminal module 3 is entirely received in the receiving portion 210. The signal terminals 31 are arranged in two row-arrays along the card inserting direction and the contacting portions extend beyond a top surface of the body portion 30 and into the card receiving room so as to electrically contact with the electrical card 5.

Figure 7:
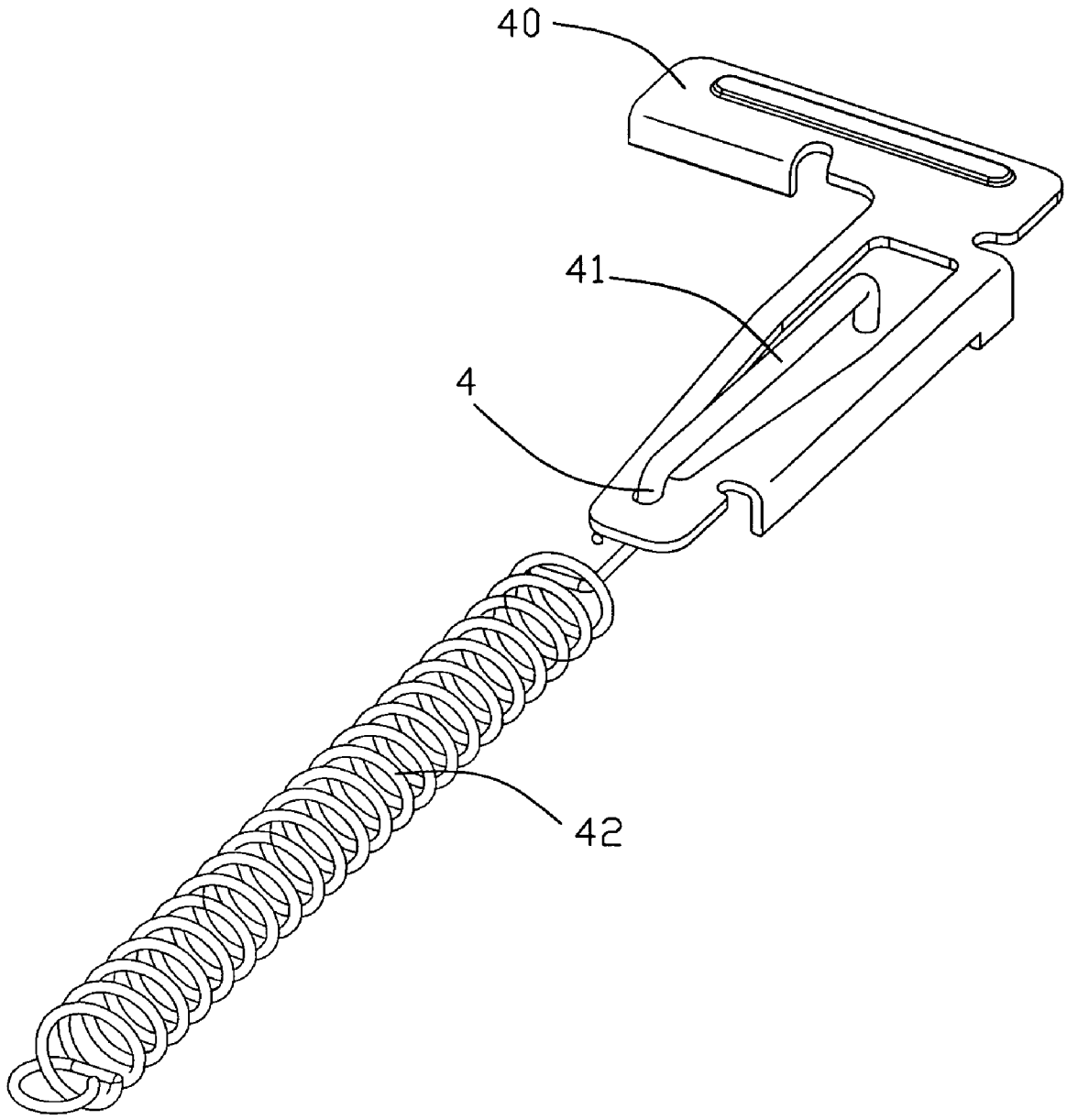
FIG. 7 is a perspective, assembled view of an ejector.
Figure 8:
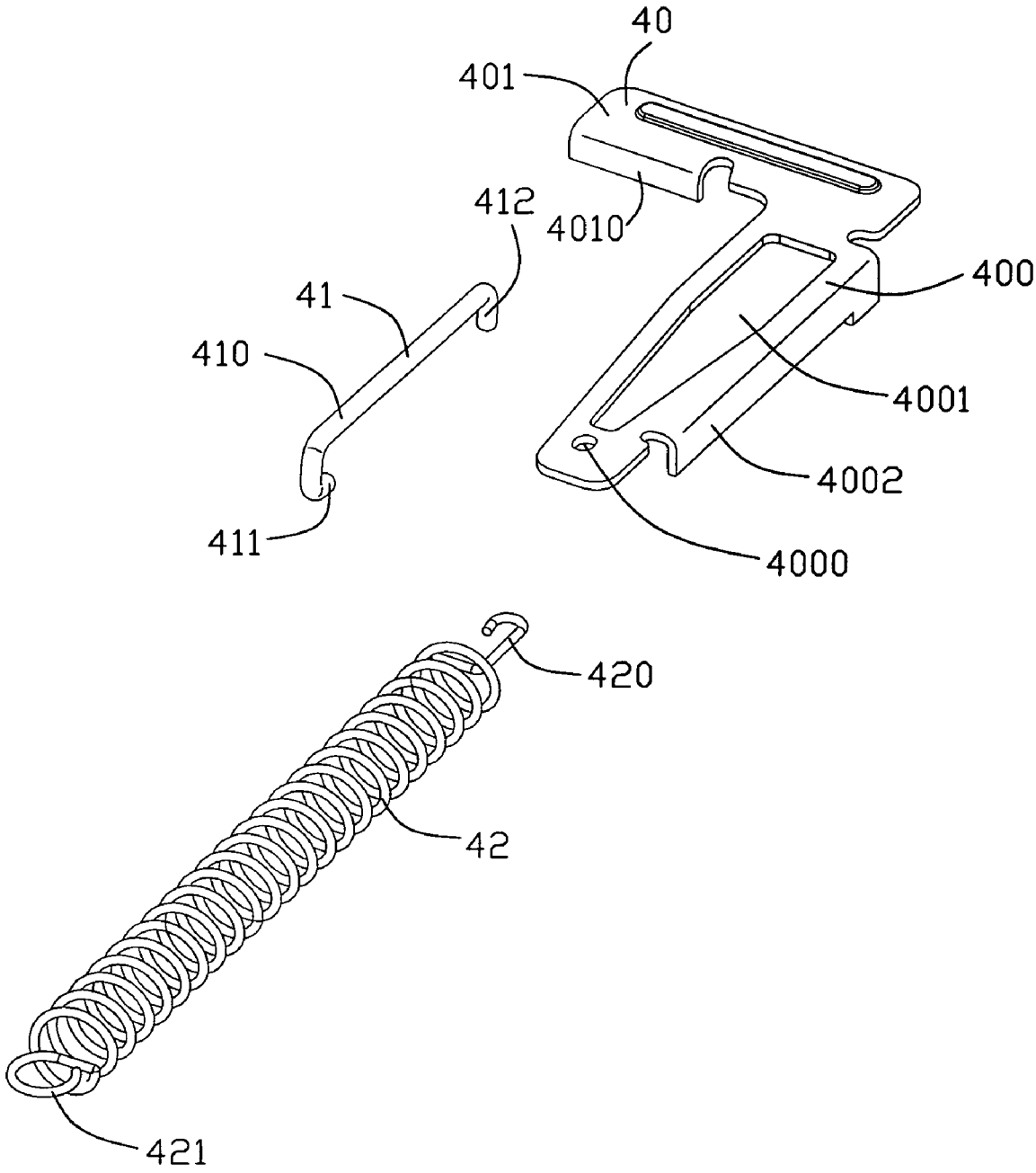
FIG. 8 is a perspective, exploded view of the ejector.

Especially referring to FIGS. 7-8, the ejector 4 comprises a drawer plate 40, a slider pin 41 and a resilient portion 42 (as a spring in this embodiment). The drawer plate 40, which is configured of L-shape, forms a first arm plate 400 extending along the card inserting direction and a second arm plate 401 extending at a right-angle from a distal end of the first arm plate 400 in a horizontal plane. The first arm plate 400 defines a retaining hole 4000 at a front part thereof for the slider pin 41 extending through, a limiting hole 4001 at a rear part thereof for confining movement of the slider pin 41 and a guiding wall 4002 extending vertically and downwardly from a right hand side of the first arm plate 400. The guiding wall 4002 is movably received in the guiding channel 2010 of the insulating housing 2. The second arm plate 401 comprises a confronting surface 4010 extending vertically and downwardly from an inner side thereof so that the electrical card 5, whose front edge confronts with the confronting surface 4010, can be drawn out of the card receiving room by the drawer plate 40 when a second thrust is pressed on the electrical card 5 (a first thrust pushes the electrical card 5 into the card receiving room). The slider pin 41 comprises a main portion 410 stretching along a line, a first bending corner 411 bending downwardly from a first distal end of the main portion 410 and a second bending corner 412 also bending downwardly from the other distal end of the main portion 410. The first bending corner 411 has a free end thereof extending towards the second bending corner 412. The first bending corner 411 goes through the retaining hole 4000 and locks with the resilient portion 42. The second bending corner 412 is limited by the limiting hole 4001 and movably received in the sliding channel 2011 and the heart-shaped channel 2012. The resilient portion 42 forms a hook at each end. The first hook 420 locks with the first bending corner 411 of the slider pin 41 and the second hook 402 locks with the recesses 153 of the fixing piece 152 of the metal shield 1 for not breaking off the metal shield 1.

The slider pin 41 of the ejector 4 sliding in the heart-shaped channel 2012 during the push-and-pull of the electrical card 5 is a prior art, so, it is not described here for detail.

The slider pin 41 of the ejector 4 in this invention, comprises the first bending corner 411 extending vertically and downwardly from one end of the main portion 410, extending through the retaining hole 4000 of the drawer plate 40 and locking with the resilient portion 42, and the second bending corner 412 also extending vertically and downwardly from the other one end of the main portion 410, which is confined to the limiting hole 4001 and slides in the heart-shaped channel 2012. For the two bending corners 411, 412 of the slider pin 41 extend toward the same direction, it effectively reduces the height of the whole electrical card connector 100 and improves a competition of the product.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical card connector, comprising:

an insulating housing;

a plurality of terminals received in the insulating housing;

a metal shield shielding over the insulating housing to define a card receiving room and a card inserting direction; and an ejector comprising an L-shaped drawer plate, a slider pin and a resilient portion, the drawer plate defining a retaining hole and a limiting hole at a backside of the retaining hole, the slider pin forming a bending corner at each end thereof, one of the bending corners extending through the retaining hole and the other bending corner being confined to the limiting hole;

wherein the one bending corner has a free end extending towards the other bending corner;

wherein the resilient portion forms a hook at each end thereof, one hook engaging with the one bending corner;

wherein the insulating housing comprises a depressed portion and an L-shaped depressed portion located at a side of the depressed portion to receive the L-shaped drawer plate therein;

wherein a plurality of limiting boards extended from side walls of the housing horizontally and inwardly locate above the depressed portion;

wherein the L-shaped depressed portion comprises a guiding channel, a sliding channel arranged at a side of the guiding channel and a heart-shaped channel between the guiding channel and the sliding channel and communicating with the sliding channel.

2. The electrical card connector as described in claim 1, wherein the metal shield comprises a base, a first lateral wall located at one side of the base, a second lateral wall and a third lateral wall located at an opposite side of the base, and a distance between the first and second lateral walls is shorter than that between the first and third lateral walls.

3. The electrical card connector as described in claim 2, wherein each lateral wall forms a locking board, and the locking board of the second lateral wall comprises a fixing piece extending vertically and upwardly.

4. The electrical card connector as described in claim 3, wherein the other hook of the resilient portion engages with the fixing piece of the metal shield.

5. The electrical card connector as described in claim 1, wherein the other bending corner of the slider pin is movably received in the sliding channel and the heart-shaped channel.

6. The electrical card connector as described in claim 1, wherein the drawer plate comprises a guiding wall received in the guiding channel of the insulating housing.

7. The electrical card connector as described in claim 1, wherein the terminals are arranged in two-row arrays on a terminal module which is received in the insulating housing.

8. The electrical card connector as described in claim 7, wherein each terminal has a contacting portion and a soldering portion, and the contacting portions, extend beyond a top surface of the terminal module and into the card receiving room.

9. An electrical card connector comprising:

an insulative housing having an L-shaped depressed portion;

a plurality of terminals disposed in the housing;

a metallic shield associated with the housing and commonly defining a card receiving space into which contacting portions of the terminals extend;

a channel region formed at a side of the housing and beside the card receiving space;

an ejector being movable along a front-to-back direction including:

an L-shaped drawer plate positioned in the L-shaped depression portion having an lateral arm extending into the card receiving space;

a slider pin having one end pivotally mounted upon the drawer plate and the other end moveable along corresponding channels in the channel region; and an extendable spring constantly pulling the ejector backwardly;

wherein the drawer plate defines a retaining hole through which said end of the slider pin connects and a limit hole through which the other end extends;

wherein said extendable spring is connected to said one end of the slider pin;

wherein a plurality of limiting boards extended from side walls of the housing horizontally and inwardly locate above the depressed portion;

wherein the L-shaped depressed portion comprises a guiding channel, a sliding channel arranged at a side of the guiding channel and a heart-shaped channel between the guiding channel and the sliding channel and communicating with the sliding channel.

* * * * *